United States Patent [19]

Inaba et al.

[11] Patent Number: 4,517,015

[45] Date of Patent: May 14, 1985

[54] STEEL REFINING METHOD

[75] Inventors: Hideaki Inaba, Chita; Shuzi Sakakibara, Handa, both of Japan

[73] Assignee: Daido Tokushuko Kabushiki Kaisha, Nagoya, Japan

[21] Appl. No.: 579,822

[22] Filed: Feb. 13, 1984

[30] Foreign Application Priority Data

Feb. 12, 1983 [JP] Japan ..... 58-21887

[51] Int. Cl.[3] ..... C21C 5/52

[52] U.S. Cl. ..... 75/12; 75/10 R; 75/59.3

[58] Field of Search ..... 75/10–12, 75/51–59, 60

[56] References Cited

U.S. PATENT DOCUMENTS 3,708,599 1/1973 Krause ..... 75/12

3,791,813 2/1974 Ramachandran ..... 75/60

3,854,932 12/1974 Bishop ..... 75/60

4,178,173 12/1979 Gorges ..... 75/60

*Primary Examiner*—Peter D. Rosenberg

*Attorney, Agent, or Firm*—Armstrong, Nikaido, Marmelstein & Kubovcik

[57] ABSTRACT

A steel refining method of the type in which the steel is refined through an interfacial reaction between the molten steel in a vessel and a slag on the molten steel. The method simultaneously employs both of blowing of an inert gas into the molten steel from the bottom of the vessel to stir the molten steel by bubbling and blowing an inert gas from the upper side of the vessel into the zone on which the movement of the slag is dull. Consequently, the stirring effect on the molten steel is enhanced to promote the refining reaction. The inert gas can contain a desulfurization agent.

4 Claims, 3 Drawing Figures

STEEL REFINING METHOD

BACKGROUND OF THE INVENTION

The present invention relates to an improvement in the steel refining method which makes use of a slag.

Refining of a steel, particularly desulfurization of the steels by a basic slag, is carried out through the following interfacial reaction between the slag and the molten steel.

$$3CaO+3S+2Al \rightarrow 3CaS+Al_2O_3$$

In order to attain a fast desulfurization, it is necessary that the following three conditions are met.

(1) The above-mentioned reaction takes place and proceeds quickly.

(2) The S contained in the molten steel quickly transfers to the interface.

(3) The formed CaS diffuses into the slag from the interface.

Hitherto, in the steel refining making use of a slag, an inert gas such as argon gas is blown into the vessel containing the molten steel from the bottom of the vessel through a porous plug to stir the molten steel through bubbling thereby to promote the refining.

The present inventors have made an intense study on the mechanism of the above desulfurization, in order to eatablish a technology for attaining a quicker steel refining, and have discovered the following facts.

(a) The transfer of the S in the molten steel as mentioned in (2) above is promoted in the intial stage thanks to the bubbling.

(b) However, in the initial stage, the transfer of CaS in the slag mentioned in (3) above takes place only at a low speed so that the reaction mentioned in (1) above also proceeds at a corresponding small rate.

(c) In the final stage, the transfer of S in the molten steel is rate-determining.

These facts suggest that the refining speed can be increased by effecting a stronger stirring by bubbling. It is, however, not allowed to strengthen the bubbling unlimitedly, because the vessel containing the molten steel usually has the form of a ladle, and the height of freeboard, i.e., the wall above the molten metal surface of this vessel is as small as 30 cm and does not exceed 50 cm at the greatest, and therefore, a too vigorous bubbling tends to cause an overflow of the slag or molten steel beyond the top of the wall of the vessel. Needless to say, it is not preferred from the view point of effective volume of the vessel to preserve a large freeboard.

A further study proved that the conventional stirring by bubbling suffers from the following problem. Namely, this conventional method inevitably causes a local dulling of the movement or flow of the slag. As a result, the interfacial reaction and the movement of CaS in the slag are impaired in these regions where the movement of the slag is dull. In addition, this conventional method cannot provide sufficient stirring effect uniformly over all portions of the molten steel.

SUMMARY OF THE INVENTION

Accordingly, it is a primary object of the invention to overcome the above-described problems of the prior art by providing a steel refining method in which, in addition to the conventional blowing of inert gas from the bottom of the vessel, a blowing of inert gas is made from the upper side of the vessel. This method, therefore, will be referred to as "duplex stirring", hereinunder.

To this end, according to the invention, there is provided a steel refining method of the type in which the steel is refined through an interfacial reaction between the molten steel in a vessel and a slag on the molten steel. The method comprises, while blowing an inert gas into the molten steel from the bottom of the vessel to stir the molten steel by bubbling, blowing an inert gas from the upper side of the vessel into the zone of the molten steel or the slag where the movement of the slag is dull to enhance the stirring of the molten steel thereby to promote the refining reaction.

The above and other objects, features and advantages of the invention will become clear from the following description of the preferred embodiments taken in conjunction with the accompanying drawings.

DESCRIPTION OF THE PREFERRED EMBODIMENT

Figure 1:
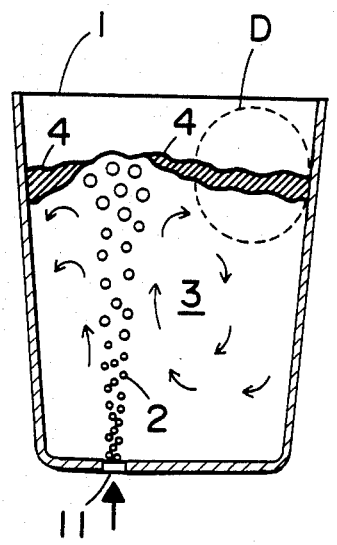
FIG. 1 is a vertical sectional view of a ladle for explaining a conventional steel refining method.

Referring first to FIG. 1 showing a conventional stirring, an inert gas 2 is blown into molten steel 3 in a ladle 1 through a porous plug 11 provided at the bottom of the ladle 1. The inert gas ascends through the molten steel 3 to stir and circulate the molten steel 3 as indicated by arrows thereby to enhance the contact between the molten steel 3 and a slag 4 covering the latter. In this conventional method, however, a zone in a broken-line circle D is left as a dead zone where the stirring is made insufficiently.

Figure 2:
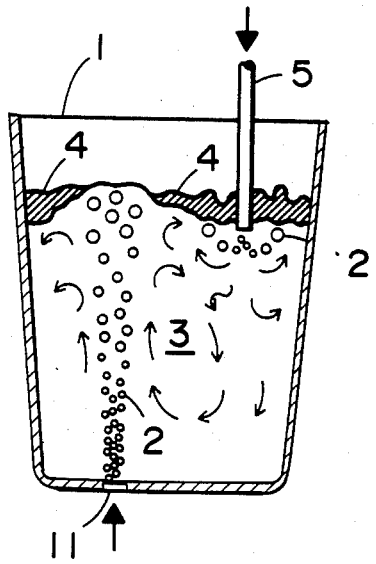
FIG. 2 is a vertical sectional view of a ladle for explaining a steel refining method of the invention employing a duplex stirring.

Referring now to FIG. 2 showing a steel refining method of the invention, a duplex stirring is effected by employing, in addition to the bottom blowing of the inert gas 2 through the porous plug 11, a blowing of the inert gas 2 from the upper side of the ladle 1 by means of an immersed lance 5, thereby to cause a sufficient stirring effect even in the zone D. For attaining a sufficient desulfurization effect, the position of the blowing of the inert gas from the upper side is changed in accordance with the proceed of the rate-determining step. More specifically, a remarkable effect is obtained by blowing the inert gas to the area near the interface between the molten steel and the slag, particularly to the portion of the slag close to the interface, in the earlier stage of the refining, while blowing the same into the molten steel in the later stage of the refining.

The inert gas 2 used for the duplex stirring can contain a desulfurization agent. In this case, however, it is preferred to blow the gas to a certain depth into the molten steel to afford a sufficient time for the formation of the slag and the reaction between the agent and the molten steel.

The rates of supply of the inert gas blown from the bottom and the upper side of the ladle, as well as the ratio therebetween, should be determined suitably to attain the strongest stirring effect. It is advisable to make full use of the existing system for blowing from the bottom, while effecting the blowing from the upper side to make up for any insufficiency of the stirring caused by the blowing from the bottom.

By way of an example, the following Table shows the rates (units:normal liter/minute) of supply of the inert gas from the bottom and upper side of the ladle in comparison with the conventional stirring which employs the bubbling from the bottom solely, employed in the refining of a batch (80 tons) of molten steel.

| | during power supply | during stirring |
|---|---|---|
| (conventional method) | | |
| blowing from bottom | 150–200 | 300–500 |
| (method of invention) | | |
| blowing from bottom | 150–200 | 300–500 |
| blowing from upper side | 200–300 | 300–500 |

As will be understood from this Table, the duplex stirring in accordance with the invention can be conducted even during the heating of the molten steel by arcs produced by electric power, as in the case of the conventional method.

Due to the insufficiency of the stirring, the conventional method had to be conducted in accordance with a pattern or flow which has, for example, the steps of supplying electric power for 10 to 15 minutes with reduced stirring power, stirring at medium strength for 3 minutes, supplying the electric power again for 10 to 15 minutes with reduced stirring power, stirring at medium strength for 3 minutes, supplying as desired the electric power for 5 to 10 minutes with reduced stirring power, and finally effecting a stirring for 4 to 5 minutes.

It is to be noted that the steel refining method employing the duplex stirring remarkably shortens the time length required for the stirring during the suspension of the electric power supply. This in turn decreases the amount of heat which is lost during the stirring and, hence, to shorten the time length of the next electric power supply. Consequently, a considerable time is saved throughout the cycle of the refining process.

In the case of an ordinary refining operation, 10 to 15 minutes are saved per cycle by adopting the refining method of the invention. In fact, it becomes possible to produce a low-sulfur steel having a sulfur content as small as less than 0.002%, in each cycle which is completed in a short time of 60 minutes.

It is true that the method of the invention causes an increase of the rate of supply of the gas per unit time. However, since the blowing time is shortened in the method of the invention, the total consumption of the gas per cycle can be maintained substantially at the same level as that in the conventional method or, if the operation is conducted under adequate conditions, reduced to a level below that in the conventional method. Needless to say, the shortened time length for the electric power supply reduces the electric power consumption and, accordingly, contributes remarkably to the reduction of the cost.

EXAMPLE

A batch (80 tons) of molten steel was refined using a basic slag in order to produce a low-sulfur steel having an extremely small sulfur content. The refining was conducted in both methods: namely, the conventional method which employs solely the blowing of the gas from the bottom of the vessel and the method of the invention which employs the duplex stirring, in accordance with the following operation patterns, respectively.

Conventional Method supplying electric power for 15 minutes; effecting stirring for 2 minutes with inert gas blowing from the bottom at a rate of 500 $Nm^3$/min); supplying electric power for 10 minutes; and effecting stirring for 3 minutes.

Method of Invention 20 minutes electric power supply with 5 minutes stirring.

Figure 3:
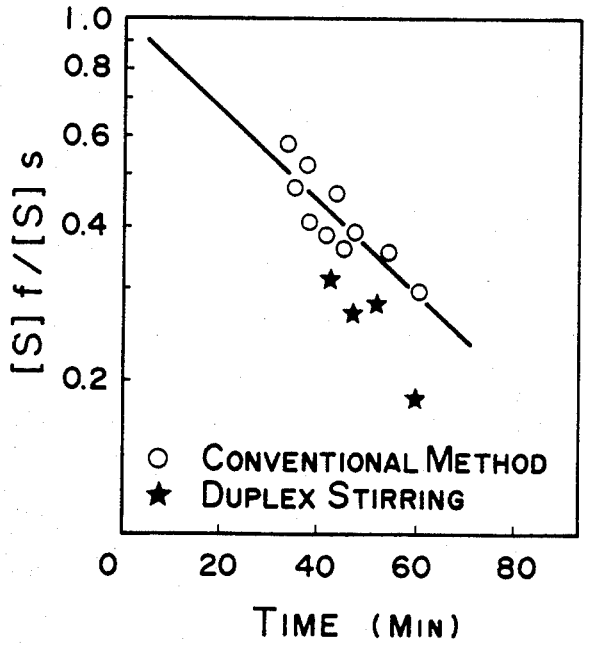
FIG. 3 is a graph showing the desulfurization effect provided by the steel refining method of the invention.

The rate of supply of the gas from the lower side was 200 $Nm^3$. During the duplex stirring of the invention, the inert gas was blown at a rate of 300 $Nm^3$ from each of the upper and lower sides. Representing the sulfur content of steel at the time of starting of the refining and at the time of finishing of the refining by [S]s and [S]f, respectively, the desulfurization ratio [S]f/[S]s was used as the index for evaluating the effects of these methods. FIG. 3 shows the speed of the desulfurization, i.e., how the desulfurization ratio mentioned above is changed in relation to time. From this Figure, it will be understood that the method of the invention provides a greater desulfurization effect than the conventional method.

Although the invention has been described through specific terms, it is to be noted that the described embodiment is only illustrative and various changes and modifications may be imparted thereto without departing from the scope of the invention which is limited solely by the appended claims.

What is claimed is:

1. In a steel refining method wherein the steel is refined in a vessel through an interfacial reaction between the molten steel and a layer of slag on the molten steel, the improvement comprising, blowing a gas consisting of an inert gas into the molten steel from the bottom of said vessel to stir the molten steel by bubbling and, at the same time, blowing a gas consisting of an inert gas from the upper side of the vessel into a zone of the slag where movement of the slag is slow relative to other zones of the slag whereby stirring of the molten steel is enhanced thereby promoting the refining reaction.

2. A steel refining method according to claim 1, wherein the slag contains a large amount of CaO and the refining reaction is mainly a desulfurization reaction.

3. A steel refining method according to either one of claims 1 and 2, wherein the blowing of the inert gas from the upper side of the vessel is made into the slag or the interface between the slag and the molten steel in an early stage of the refining process and into the molten steel in a later stage of the refining process.

4. A steel refining method according to any one of claims 1 to 3, wherein the stirring is effected during heating of the molten steel by electric arcs.

* * * * *